United States Patent [19]

August et al.

[11] Patent Number: 4,700,996

[45] Date of Patent: Oct. 20, 1987

[54] ZIE EDGE CONNECTOR

[75] Inventors: Melvin C. August; Stephen A. Bowen; John T. Williams, all of Chippewa Falls, Wis.

[73] Assignee: Cray Research, Inc., Minneapolis, Minn.

[21] Appl. No.: 916,509

[22] Filed: Oct. 8, 1986

[51] Int. Cl.[4] ..... H01R 13/62

[52] U.S. Cl. ..... 439/268; 439/265; 439/359

[58] Field of Search ..... 339/74 R, 75 M, 75 MP

[56] References Cited

U.S. PATENT DOCUMENTS

| | | | |
|---|---|---|---|
| 2,724,093 | 11/1955 | Preston | 339/34 |
| 4,076,362 | 2/1978 | Ichimura | 339/75 MP |
| 4,327,955 | 5/1982 | Minter | 339/75 MP |
| 4,352,533 | 10/1982 | Murase et al. | 339/17 L |
| 4,392,700 | 7/1983 | Showman et al. | 339/75 MP |
| 4,591,219 | 5/1986 | Reimer | 339/75 MP |

OTHER PUBLICATIONS

Page 238, 1982–1983 ITT Cannon Connectors Catalog, PC Edgecard Connector PB21/PB18 Series.

Page 280, 1984–1985 ITT Cannon Connectors Catalog, Zero Insertion Force Modular Edgecard Connectors.

*Primary Examiner*—John McQuade

*Attorney, Agent, or Firm*—Merchant, Gould, Smith, Edell, Welter and Schmidt

[57] ABSTRACT

An electrical edge connector (14) of the zero insertion force type includes a pair of opposing blocks (30, 32) defining a longitudinal guideway (34) therebetween. Opposite corresonding pairs of female contacts (52, 54) are disposed in transverse holes in the blocks (30, 32), and male contacts (60) are slidably supported in the female contacts in one block for selective actuation into or out of sliding engagement with the female contacts in the other block responsive to insertion of a slider (36).

5 Claims, 6 Drawing Figures

FIG. 1
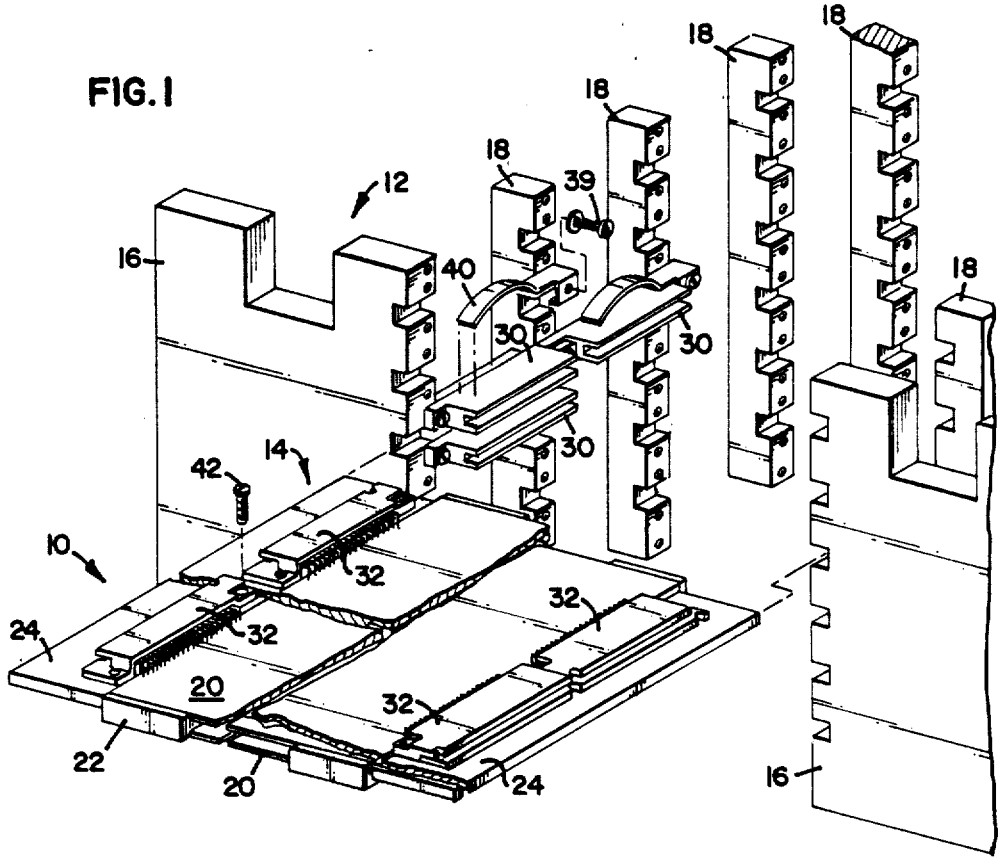
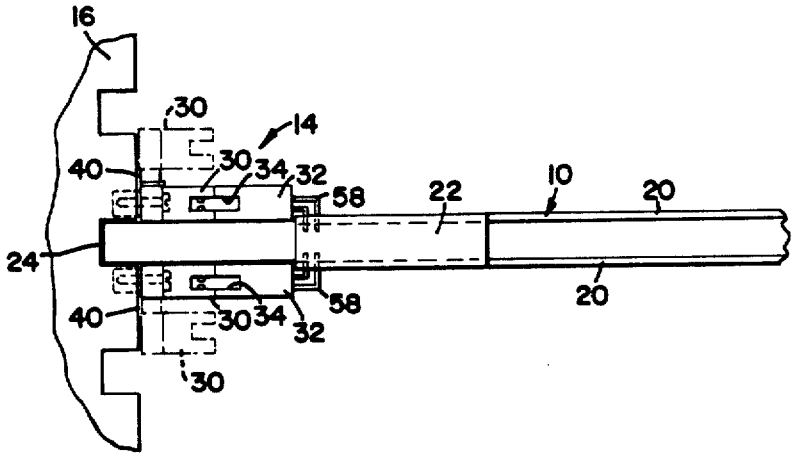
FIG. 2

FIG.5
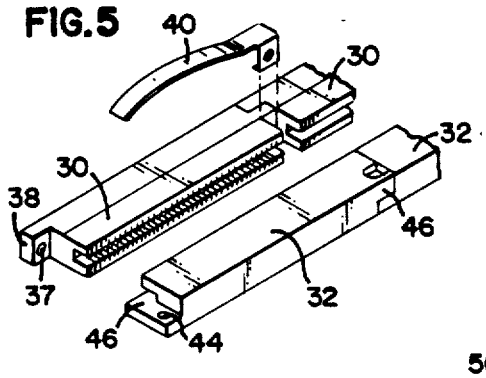
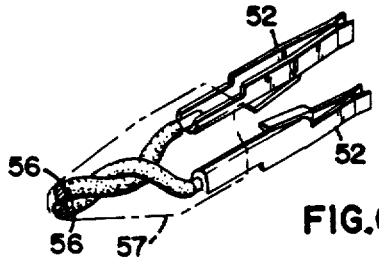
FIG.6
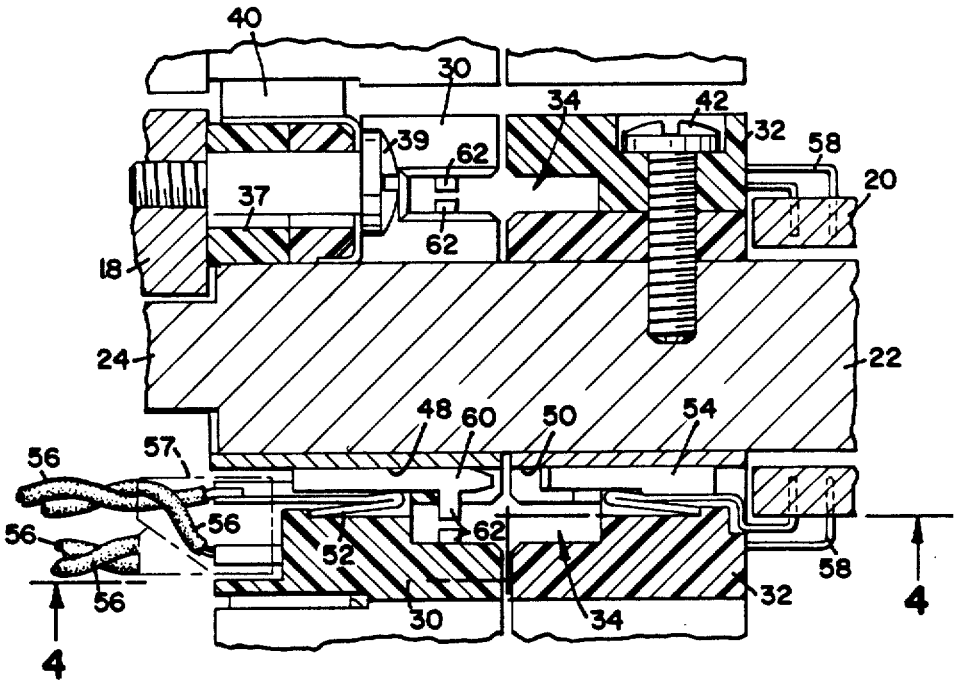
FIG.3

ZIE EDGE CONNECTOR

TECHNICAL FIELD OF THE INVENTION

The present invention relates generally to an electrical connector, and more particularly to a zero insertion force (ZIF) edge connector wherein a multiplicity of electrical contacts are made or broken by individually slidable transverse pins responsive to insertion of a longitudinal slider.

BACKGROUND ART

High-speed electronic digital computers of the type produced by Cray Research, Inc., the assignee hereof, utilize banks of interconnected circuit modules. Each circuit module includes two circuit boards mounted in close proximity on opposite sides of a cooling plate. Each circuit board in turn includes numerous miniaturized logic and memory devices. Computers of this type thus tend to have high circuit densities and numerous input and output signals, connections for which must be provided. Further, the trend is toward computers of greater capacity, increasing circuit densities, and thus even more connections.

A variety of electrical connectors have been available heretofore for use with printed circuit boards, however, there have been certain drawbacks with the prior connectors. For example, the most common approach has been to provide a plug-in type connector consisting of complementary male and female contacts including numerous pins for making or breaking multiple contacts simultaneously. Of course, as the number of pin contacts increases, the insertion force required also increases along with the chances of misalignment and thus damage. It will be appreciated that connectors of this type are not especially tolerant to misalignment and the pins therein can easily become damaged during attempted connection if misaligned even slightly.

U.S. Pat. No. 4,352,533 shows a connector device for printed circuit boards comprising a pair of opposed male portions and an intermediate slidable shuttle portion. The male portions include opposing aligned pins, the pins on one portion being relatively longer than those on the other portion. The female shuttle includes dual entry female contacts which are supported by and moveable along the long pins of one male portion into or out of engagement with the short pins on the other male portion to make or break electrical contact. The shuttle portion is cam actuated, but in mass connect/disconnect fashion.

On the other hand, the PB 18 printed circuit board connector assembly from ITT Cannon of Mountain Valley, Calif., utilizes a cam for sequentially opening or closing pairs of contacts in zipper fashion. This connector, however, utilizes pre-loaded spring contacts which are normally biased toward engagement with finger contact pads on the edge of the PC board. This type of connector is thus a zero-insertive force-type connector, but relies upon spring tension for surface pressure contact, which is not as reliable as a wiping action-type contact. Further, the slider must be left in place to keep the spring contacts open. This connector also tends to be somewhat bulky.

A need has thus arisen for a new and improved ZIP edge connector of more compact construction wherein electrical contact is made or broken sequentially under a wiping action with greater reliability.

SUMMARY OF INVENTION

The present invention comprises a ZIF edge connector that overcomes the foregoing and other difficulties associated with the prior art. In accordance with the invention, there is provided an electrical connector of the zero insertion force type whereby a multiplicity of electrical contacts are made or broken sequentially, rather than en masse, responsive to insertion of a slider. The connector herein comprises a pair of opposing connector block portions, one of which is adapted for mounting on the frame and the other of which is adapted for mounting along the edge of a circuit board. Adjacent edges of the connector block portions include longitudinal notches therein defining a guideway for a slider. Each connector block portion includes two vertically spaced apart, staggered rows of transverse openings therein adjoining the opposite upper and lower sides of the notch. Female contacts are provided in the transverse openings of the connector block portions. Slidable male contacts or pins are supported in the female contacts of one connector block portion. The male contacts include cam lobes extending into the guideway so that, when the slider is inserted, they can be sequentially actuated into or out of engagement with the female contact in the opposite corresponding opening in the other connector block portion.

BRIEF DESCRIPTION OF DRAWINGS

A better understanding of the invention can be had by reference to the following Detailed Description in conjunction with the accompanying Drawings, wherein:

FIG. 1 is an exploded perspective view of a circuit board module and part of a computer frame;

FIG. 2 is an enlarged partial end view of the circuit board module inserted into the frame;

FIG. 3 is an enlarged cross-sectional view of the ZIF edge connector herein;

FIG. 5 is a perspective illustration of the two block portions of the edge connector herein; and FIG. 6 is a perspective illustration of a pair of female contacts suitable for use with the edge connector herein.

DETAILED DESCRIPTION

Figure 4:
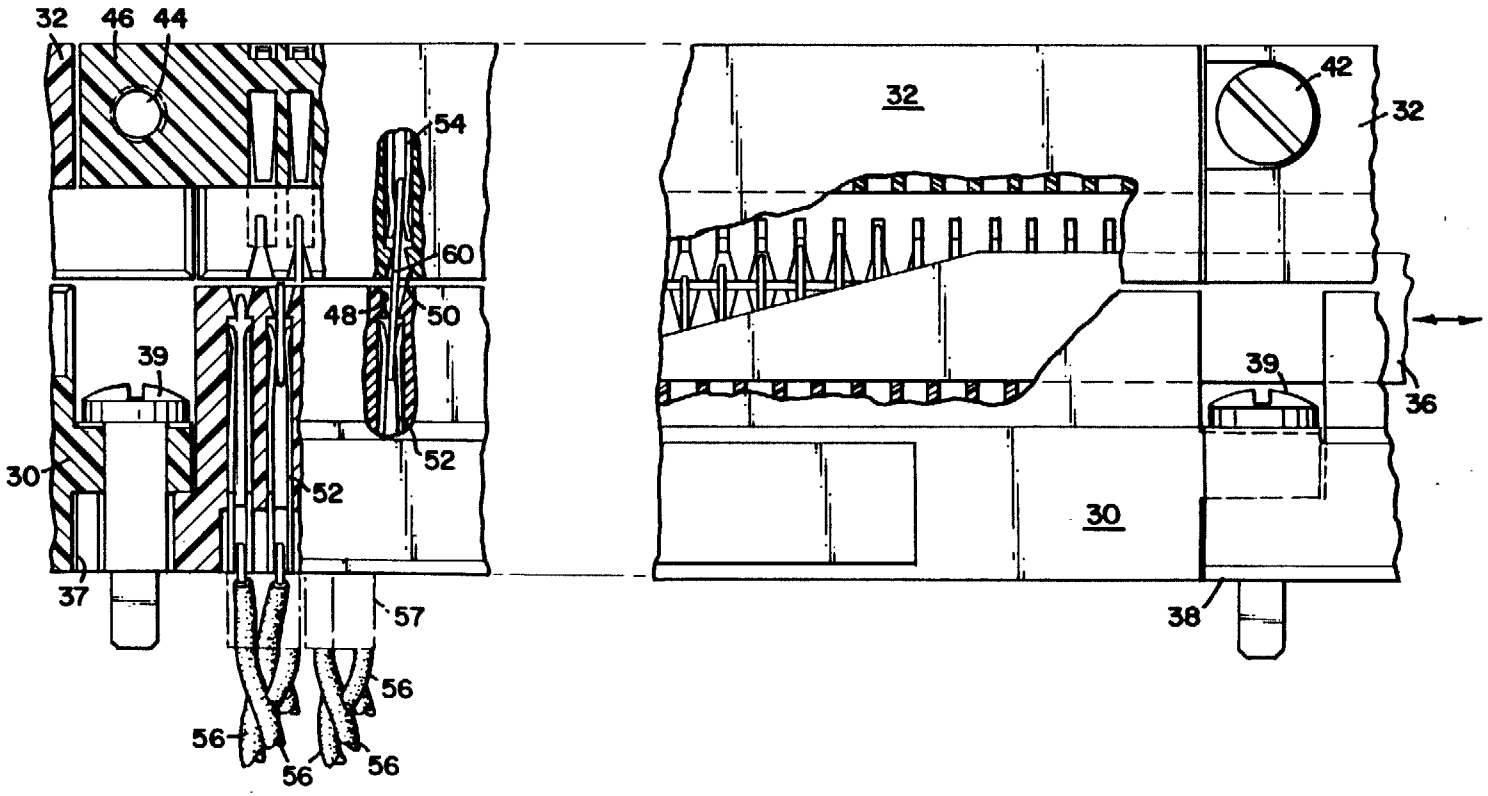
FIG. 4 is cross-sectional view taken along lines 4—4 of FIG. 3 in the direction of the arrows.

Referring now to the Drawings, and particularly referring to FIG. 1, there is shown a circuit module 10 and a frame 12 of a computer (not shown) interconnected by the ZIF edge connectors 14 of the invention. The frame 12 includes end plates 16, only two of which are shown, and a number of intermediate bars 18 arranged in opposing laterally spaced-apart pairs. The adjacent edges of the end plates 16 and bars 18 are notched or slotted as shown for receiving a stack or bank of circuit modules 10 therein. For purposes of illustration, only one circuit module 10 has been shown.

The circuit module 10 includes a pair of printed circuit boards 20 arranged on opposite sides of a cooling plate 22. Flanges 24 are provided on opposite lateral sides of the cooling plate 22 for receipt in the notched edges between the end plates 16 and intermediate bars 18 of the frame 12, as shown.

As will be explained more fully hereinafter, the connectors 14 of the invention are mounted along opposite edges of the circuit module 10 and are adapted to provide essentially zero mechanical resistance upon insertion of the modules into frame 12, after which the connectors along each edge of the module can then be sequentially actuated in the fashion of a zipper to establish multiple electrical connections with better reliability.

The constructional details of the edge connector 14 are shown in FIGS. 2–6. Each edge connector 14 includes two opposing connector block portions 30 and 32 formed of suitable nonconductive material. Adjacent edges of the connector portions 30 and 32 include longitudinal slots therein defining a guideway 34 through the connector, as is best seen in FIG. 2, for receiving the slide 36 as shown in FIG. 4, for selectively actuating or deactuating the connector 14.

The connector portions 32 are secured to frame 12 by screws 39 which extend through holes 37 in lugs 38 provided at opposite ends of each such connector portion, as shown. The lugs 38 are preferably laterally offset, as is best seen in FIG. 5, so that a common screw 39 can be utilized for securing the ends of each two adjacent connector portions 30 in a row of connectors 14. In addition, a spring clip 40 is secured between adjacent connector portions 30 for purposes of resiliency. The spring clips 40 bear upon the adjacent row of connector portions 30 for the next adjacent circuit module 10 in the frame 12.

A similar number of connector portions 32 are secured in a row along the edge of the circuit module 10. As illustrated, a row of connector portions 32 is mounted on each flange 24 of the cold plate 22, on each side thereof, for each circuit board 20. Four rows of connector portions 32 are thus provided on each circuit module 10. The connector portions 32 are secured to the circuit module 10 by screws 42 extending through holes 44 in lugs 46 at opposite ends of the connector portions 32. Again, the lugs 46 are preferably offset, but in a vertical direction, so that a common screw 42 can be utilized to secure the ends of each two adjacent connector portions 32 in the row.

As mentioned above, opposing edges of the connector block portions 30 and 32 include longitudinal slots defining the guideway 34. The connector portions 30 and 32 also include arrays of transverse holes or openings therein containing female connectors. For example, the connector portion 30 includes transverse holes 48 extending between opposite sides thereof, while the connector portion 32 includes similar transverse holes 50 extending between opposite sides thereof. The inner ends of holes 48 and 50 adjoin the slots in the connector portions 30 and 32, respectively, one row being provided on either side of the slots. Female contacts 52 and 54 are provided in holes 48 and 50, respectively, in opposite corresponding pairs. Any type of suitable female contacts can be used. For example, contacts of the type shown in FIG. 6, which are available from ITT Cannon of Santa Ana, Calif., can be utilized for female contacts 52 and 54. If desired, dual ribcage contacts like that shown in U.S. Pat. No. 4,445,747, which are available from Berg Electronics of New Cumberland, Pa., could also be used. A plurality of transverse holes 48 and female contacts 52 are provided in the connector portion 30, and a similar corresonding set of holes 50 and female contacts 54 are provided in the opposite connector portion 32. The transverse holes and female connectors in the connector portions 30 and 32 are preferably arranged in staggered rows adjoining opposite sides of the guideway 34. As illustrated, two rows of 27 for a total of 54 connections are provided. Further, the inner ends of holes 48 and 50 are preferably flared to facilitate receipt of the male contacts and to achieve better alignment tolerance, as illustrated in FIG. 3. The female contacts 52 in the connector portion 30 are connected to wires 56 leading to other connectors. The wires 56 from each vertical pair of female contacts 52 can be twisted, as shown, into a cable. If desired, a resilient molded strain relief 57 can be provided about the junction between wires 56 and contact 52. The female contacts 54 in the connector portion 32 are connected to leads 58 extending into the adjacent circuit board 20.

Referring now primarily to FIGS. 3 and 4, the edge connector 14 further includes a plurality of male contacts 60 supported in the female contacts 52 of the connector portion 30 on the frame 12. In particular, each male contact 60 comprises a substantially straight pin of round or otherwise suitable cross-section with opposite ends, and an offset tab or lobe 62 thereon extending into the guideway 34. The tab or lobe 62 is located relatively closer to the outer end of the male contact 60, which end is preferably tapered to facilitate receipt in the opposing hole 50 and female contact 52. The male contacts 60 are preferably formed of a gold plated, copper based metal alloy.

When the slider 36 is inserted into the guideway 34, the male contacts are sequentially moved into or out of engagement with the corresponding opposite female contacts 54 in the connector portion 32 in order to make or break electrical contact between the two connector portions. Since the male contacts 60 are not normally biased in either direction, it will be appreciated that the slider 36 can then be removed from the edge connector 14 without disactuating the contacts therein. In other words, after the slider 36 has been inserted with its beveled tip oriented on one side or the other as desired to open or close the contacts inside the connector 14, the slider can then be removed and the contacts will remain in position until reinsertion of the slider.

In view of the foregoing, it will be appreciated that the present invention comprises an improved edge connector having numerous advantages over the prior art. The connector herein incorporates male contacts which can be selectively actuated by means of a simple slider inserted from either end of the connector, to make or break electrical connection between female contacts in opposing blocks. Since male and female contacts are utilized, a wiping action occurs during engagement which results in a better, more direct and reliable electrical connection. Further, the edge connector herein lends itself to a more compact construction which helps improve circuit density. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. An electrical connector, comprising:

a pair of opposing blocks of nonconductive material, adjacent surfaces thereof having longitudinal slots defining a longitudinal guideway therebetween for receiving a slider;

each block further including a plurality of spaced-apart transverse openings adjoining the slot therein;

a female contact disposed in each transverse opening of each block;

a male contact slidably disposed at one end thereof in each female contact of one of said blocks; and a cam lobe secured to each male contact and extending into the slot of said one block for sequential selective actuation into and out of sliding engagement at the other end with the opposite corresponding female contact in the other block responsive to insertion of the slider into the guideway.

2. The electrical connector of claim 1, wherein the transverse openings in said blocks are arranged in two staggered rows on opposite sides of the slot in the corresponding block.

3. The electrical connector of claim 1, further including mounting lugs extending outwardly from opposite ends of each block.

4. The connector block according to claim 3, wherein said mounting lugs are staggered to facilitate use of a common fastener between adjacent blocks in a row of connectors.

5. An electrical connector, comprising:

a pair of opposing blocks of nonconductive material, adjacent surfaces thereof having longitudinal slots defining a longitudinal guideway therebetween for receiving a slider;

each block further including a plurality of spaced-apart transverse openings adjoining the slot therein, the openings being arranged in two rows on opposite sides of the slots in the corresponding block;

a female contact disposed in each transverse opening of each block;

a male contact slidably disposed at one end thereof in each female contact of one of said blocks; and a cam lobe secured to each male contact and extending into the slot of said one block for sequential selective actuation into and out of sliding engagement, at the other end, with the opposite corresponding female contact in the other block responsive to insertion of slider into the guideway.

* * * * *

UNITED STATES PATENT AND TRADEMARK OFFICE

CERTIFICATE OF CORRECTION

PATENT NO. : 4,700,996

DATED : October 20, 1987

INVENTOR(S) : Melvin C. August, et al

It is certified that error appears in the above-identified patent and that said Letters Patent are hereby corrected as shown below:

In the title, change "ZIE" to --ZIF--.

In the Abstract, line 4, change "corresonding" to --corresponding--.

In the title of column 1, change "ZIE" to --ZIF--.

In column 1, line 65, change "ZIP" to --ZIF--.

In column 6, line 22, after "of" insert --the--.

Signed and Sealed this

Fourteenth Day of June, 1988

*Attest:*

DONALD J. QUIGG

*Attesting Officer*

*Commissioner of Patents and Trademarks*